United States Patent [19]

Gray et al.

[11] Patent Number: 5,000,174

[45] Date of Patent: Mar. 19, 1991

[54] POSITIVE PRESSURE BREATHING ASSEMBLY AND DEMAND REGULATOR THEREFOR

[75] Inventors: Robert E. Gray, Glen Mills; Robert M. Armstrong, Clifton Heights; Walter J. D. Lybrand, Drexel Hill, all of Pa.

[73] Assignee: Cairns & Brother Inc., Clifton, N.J.

[21] Appl. No.: 416,394

[22] Filed: Oct. 3, 1989

[51] Int. Cl.[5] ..... A62B 9/02

[52] U.S. Cl. ..... 128/205.24; 128/207.12

[58] Field of Search ..... 128/205.24, 207.12

[56] References Cited

U.S. PATENT DOCUMENTS 4,858,606 8/1989 Hamlin ..... 128/204.29

4,889,115 12/1989 Bozano ..... 128/205.24

FOREIGN PATENT DOCUMENTS 183313 9/1955 Fed. Rep. of Germany ..... 128/205.24

*Primary Examiner*—Edgar S. Burr

*Assistant Examiner*—Eric P. Raciti

*Attorney, Agent, or Firm*—R. Gale Rhodes, Jr.

[57] ABSTRACT

There is diclosed a self-contained breathing assembly of the positive pressure type including a remotely positioned improved pressure demand regulator for substantially instantaneous response for breathing air having reduced operating parts substantially reducing potential breakdown and wherein there is provided a gas flow disconnect assembly between the user face mask and gas flow conduits.

12 Claims, 3 Drawing Sheets

POSITIVE PRESSURE BREATHING ASSEMBLY AND DEMAND REGULATOR THEREFOR

BACKGROUND OF THE INVENTION (1) Field of the Invention

This invention relates to a self-contained breathing assembly, and more particularly to an improved positive pressure self-contained breathing assembly for temporary use by a wearer in a noxious environment, such as is worn by a firefighter and including a remotely positioned pressure demand regulator as well as an improved face mask interconnect assembly.

(2) Description of the Prior Art

Self-contained breathing assemblies (SCBA's) are worn by industrial workers, and in particular firefighters, to provide a safe, respirable breathing condition while the user works in a hostile environment. Currently, breathing performance and service life rating of such apparatus are based upon user consumption at the rate of 42 liters per minute, wherein inhalation and exhalation reach peaks instantaneous flow rates of about 115 liters per minute. For firefighting duty, the National Fire Prevention Administration (NFPA) has defined new performance standards in its Standard No. 1981 (for open circuit SCBA's) wherein peak instantaneous breathing rates exceed 400 liters per minute.

Such demand regulators must be highly responsive to meet the constantly-changing pattern of human respiration and peak instantaneous flow rates of up to 400 liters per minute. Pressure-demand regulators create a positive pressure in the user's face mask throughout the respiration cycle while concomitantly providing flow corresponding to the user's demand, such as disclosed in U.S. Pat. No. 4,334,532 to Jackson. Such a pressure-demand regulator normally maintains a positive pressure of about 0.5 to 1.5 inches water-column height under static conditions (when the user is not breathing) and does not permit the face mask pressure to become negative at peak flow rates of up to 400 liters per minute.

The demand regulator may be mounted on the face piece to provide an almost instantaneous response to the user's respiratory demand, however the bulkiness restricts vision and can restrict head movement resulting from its size and hose coupling requirements. Conversely, in known designs, the regulator's response time decreases considerably if the regulator is located a distance from the facepiece, and the two are joined by a large diameter flexible tube, although the remotely located regulator affords unencumbered vision and head movement.

One problem with demand regulators used in debris-ridden and/or subfreezing environments, routinely encountered in firefighting, is that the regulator's operation may be hindered by ice and/or debris. Additionally, any debris entering the breathing tube or regulator before the face mask is donned can be blown into the wearer's face during use. One solution to this problem is the provision of a cap to be manually positioned over the regulator outlet after use.

A further problem for any pressure demand regulator is the continued flow of gas when the regulator is disconnected from the facepiece since the regulator will continue to flow to try to create a positive pressure.

OBJECTS OF THE INVENTION

An object of the present invention is to provide an improved self-contained positive pressure breathing assembly having a demand regulator located remotely from the facepiece to provide a rapid response to the user's breathing effort by using separate hoses between the facepiece and the regulator for the functions of fluid flow and pressure sensing but permitting of improved head movement and scope of vision.

Another object of the present invention is to provide an improved self-contained breathing assembly having a pressure demand regulator of improved responsiveness and reduced complexity to minimize potential breakdown.

Still another object of the present invention is to provide an improved positive pressure self-contained breathing assembly having automatic shut-off capabilities.

Yet another object of the present invention is to provide an improved self-contained positive pressure breathing assembly of improved operational characteristics.

A further object of the present invention is to provide an improved self-contained positive pressure breathing assembly substantially preventing debris ingestion upon disconnection of the regulator from the facepiece.

A still further object of the present invention is to provide an improved self-contained positive pressure breathing assembly substantially instantaneously discontinuing pressurized gas flow upon disconnection of the regulator from the facepiece.

SUMMARY OF THE INVENTION

These and other objects of the present invention are achieved in a self-contained breathing assembly of the positive pressure type including a remotely positioned improved pressure demand regulator for substantially instantaneous response for breathing air having reduced operating parts substantially eliminating potential breakdown and wherein there is provided a gas flow disconnect assembly between the user face mask and gas flow conduits.

BRIEF DESCRIPTION OF THE DRAWING

Further objects and advantages of the present invention will become apparent from the following detailed description thereof when taken with the accompanying drawings, wherein like numerals designate like parts throughout, and wherein.

DETAILED DESCRIPTION OF THE INVENTION

Figure 1:
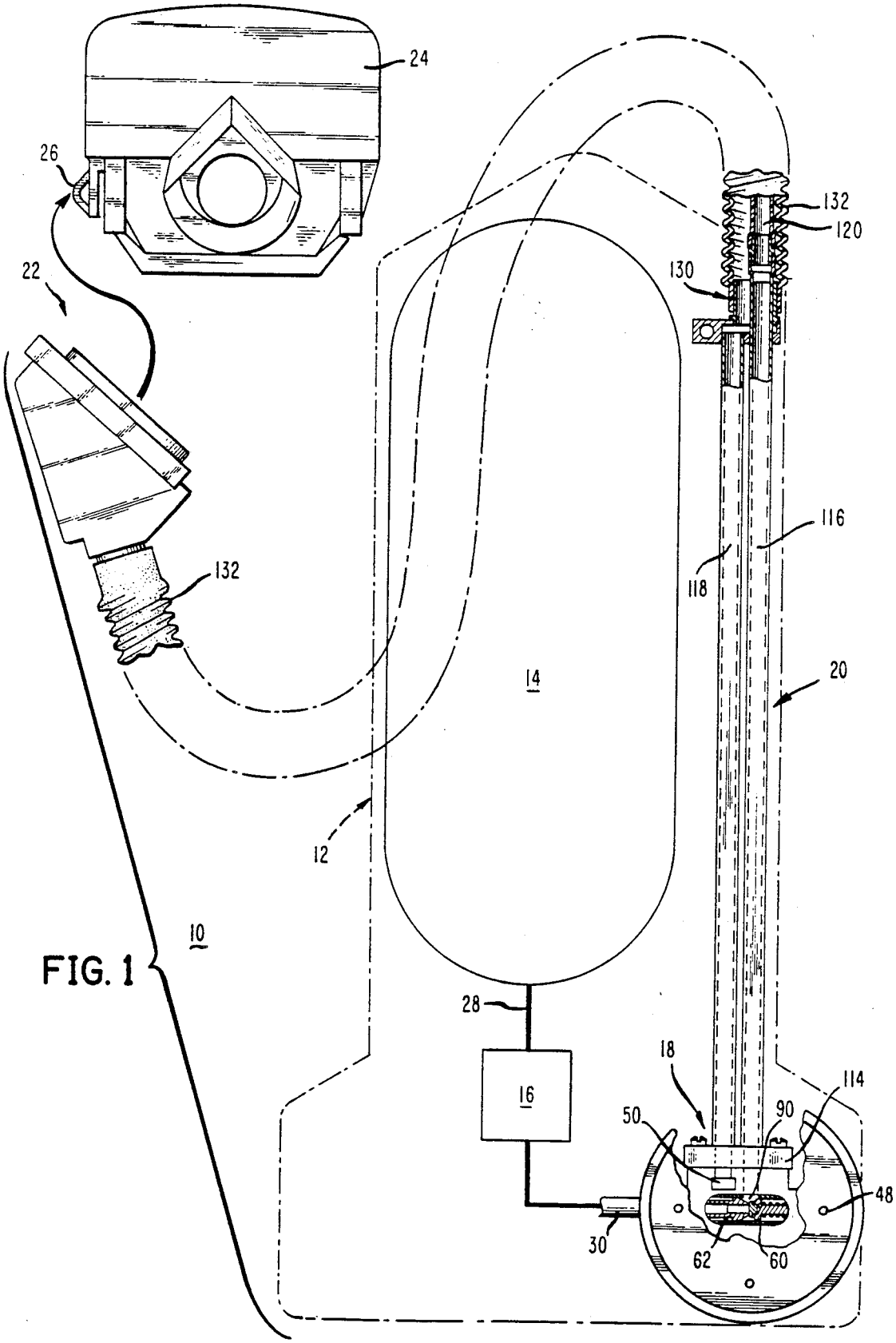
FIG. 1 is a schematic view of the positive pressure breathing assembly of the present invention.

Referring now to FIG. 1, there is illustrated a positive pressure breathing assembly of the present invention, generally indicated as 10, mounted in a supporting carrier or backpack assembly 12 (indicated by the phantom lines). The breathing assembly 10 is comprised of a compressed gas supply tank 14; a pressure reducer valve 16; a pressure demand regulator assembly 18; a gas supply conduit assembly, generally indicated as 20; a valve-face mask connecting assembly, generally indicated as 22, and a face mask 24 including a gas connect member 26. The compressed gas supply tank 14 (containing a breathable gas, most commonly air) is generally of a size to provide about 1200 liters of breathing air (which has classically been rated a "30 minute" cylinder in that it provides 30 minutes of service at a 42 liter per minute user comsumption rate), but tanks having capacities considerably larger (up to 2400 liters) or smaller (down to 400 liters) may also be used. The cylinder is connected by line 28 under the control of the pressure reducer valve 16 via a conduit 30 to the pressure demand regulator assembly 18.

Figure 2:
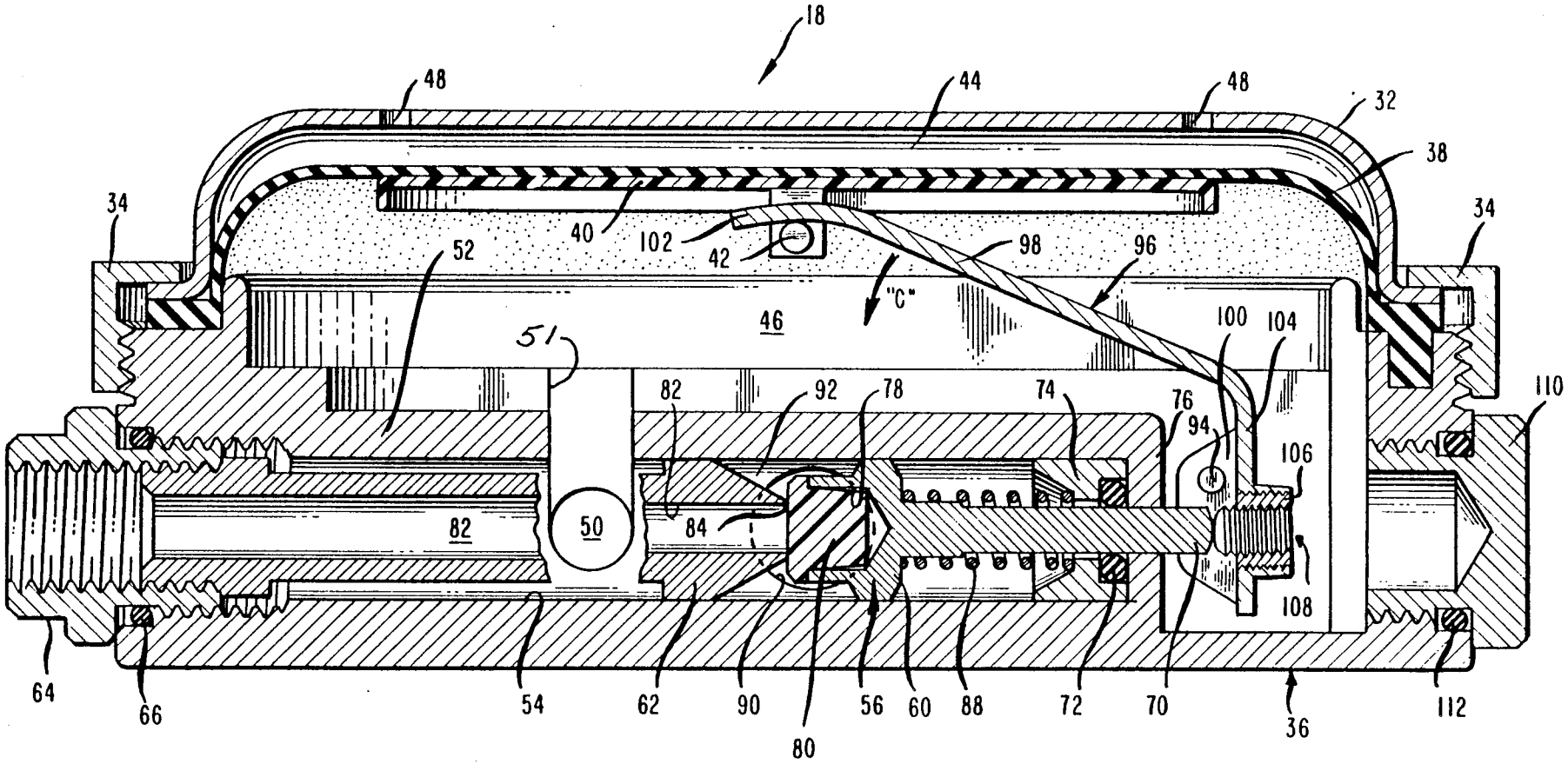
FIG. 2 is an enlarged cross-sectional view of the pressure demand regulator assembly.

The pressure demand regulator assembly 18, referring to FIG. 2 is comprised of an upper cylindrically-shaped housing member 32 threadably connected by a threaded ring 34 to a lower housing member 36 having disposed therebetween a flexible diaphragm member 38 including a disc-shaped body member 40 mounted by a mounting pin member 42 defining an upper chamber 44 and a lower chamber 46. The lower ring portion of flexible diaphragm member 38 acts as a gasket between the upper and lower housing members 32 and 36. The upper housing member 32 is provided with channels 48 for fluid flow communication between the atmosphere and the upper chamber 44 of the pressure demand regulator assembly 18. An opening 50 is provided in the lower housing member 36 to provide fluid communication between the lower chamber 46 and the conduit 118 of gas supply conduit assembly 20, as more fully hereinafter described.

The lower housing member 36 is provided with an air inlet housing 52 formed with a cylindrically-shaped chamber 54 for positioning an air valve release assembly, generally indicated as 56. The air valve release assembly 56 is comprised of a piston 60, nozzle member 62 and an inlet fitting 64 threadably positioned within the inlet chamber 54 together with an appropriate gasket member 66 which is threadably joined and sealed to the nozzle member 62. The piston 60 includes a free end portion 70 extending in fluid tight relationship through a gasket 72 which is contained between bushing 74 and an end wall 76 of the housing 52 into the lower chamber 46. The piston member 60 is formed with a chamber 78 in an end opposite the free end portion 70 for receiving a resilient valve pad 80. The nozzle member 62 includes a centrally-formed channel 82 terminating in a nozzle tip 84. The nozzle tip 84 is in contact with the resilient valve pad 80.

A coil spring 88 (under compression) is disposed about the piston 60 between a shoulder of the piston 60 and bushing 74. The air inlet housing 52 is provided with an orifice 90 in fluid communication with a feed gas chamber 92 formed about an outer surface portion of the piston 60 and nozzle member 62 with the inlet chamber 54 proximate the nozzle tip 84 of the intermediate nozzle member 62, as more fully hereinafter described.

In the chamber 46 proximate the end wall 76 of the inlet housing 52, there is provided an inwardly extending shaft member 94 for positioning a lever member, generally indicated as 96, including hinge arm 98 and a channel 100 pivotably mounted on the shaft member 94. An upper end portion 102 of the lever member 96 extends through and in contact with the pin member 42. A lower end portion 104 of the lever member 96 is formed with an outwardly extending threaded insert 106 which contains an oval head set screw 108 extending towards and in contact with the free end portion 70 of the piston 60 thereby allowing adjustment of the height of lever 96, as more fully hereinafter described. The threaded set screw 108 allows adjustment to the height of the hinge arm 96 to offset variations in production parts. Access to the screw 108 is gained by removing access port 112 sealed by gasket 110.

The gas supply conduit assembly 20, referring again to FIG. 1, is provided with a connecting member 114 connected to the lower housing 36 of the pressure demand regulator 18 and includes conduits 116 and 118 in fluid flow communication with orifices 90 and 50, respectively, formed in the lower housing member 36 of the pressure demand regulator assembly 18.

The upper portion of rigid conduit 116 is threadably connected to flexible conduit 120. The other end of flexible conduit 120 is connected to a downwardly extending conduit element 122 (FIG. 3) of the connecting assembly 22 and is in fluid flow communication with one side at the conduit element separated by a partition 124, which allows the conduit element 122 to act as a mixing chamber between the fluid flow conduit 120 and the pressure-sensing conduit 118, as hereinafter more fully described.

Figure 3:
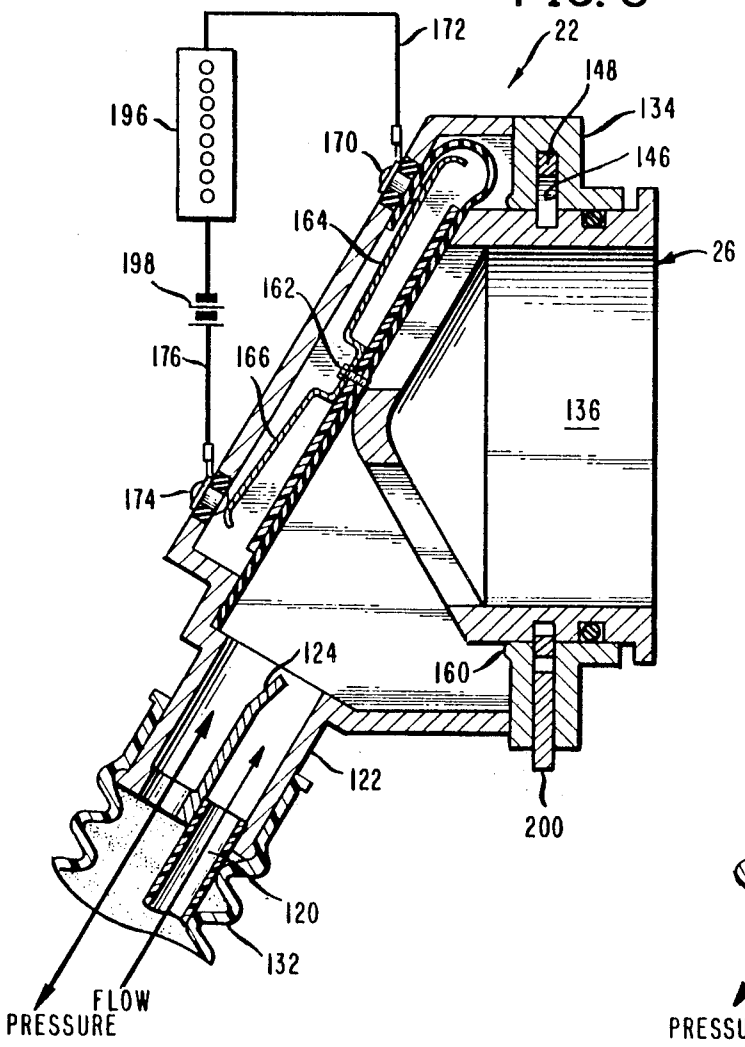
FIG. 3 is an enlarged cross-sectional view of the valve-face mask connecting assembly.

The upper portion of the conduit 118 terminates in an end member 130 encircling the conduit 116 for fluid flow mounting to a flexible conduit 132 mounted to the end member 130 at one end and to the downwardly extending conduit element 122 of the valve-face mask connecting member 22 at the upper end thereof, in fluid flow communication with the opposite side of conduit element (from that used for flow delivery), referring more particularly to FIG. 3. An adjustment device (not shown) may be provided, if necessary to the partition 124 to control the effect of fluid flow upon the pressure sensing conduit line. Suitable clamping elements (not shown) are provided to mount the flexible conduit 132 to the gas supply conduit assembly 20 and the valve-face mask connecting assembly 22.

Although this invention is described with one flexible conduit member 120 contained in a coaxial manner inside a larger diameter flexible conduit member 132, it is understood that two flexible conduits having similar size diameters running parallel to each other could be used to achieve the same function.

Figure 4:
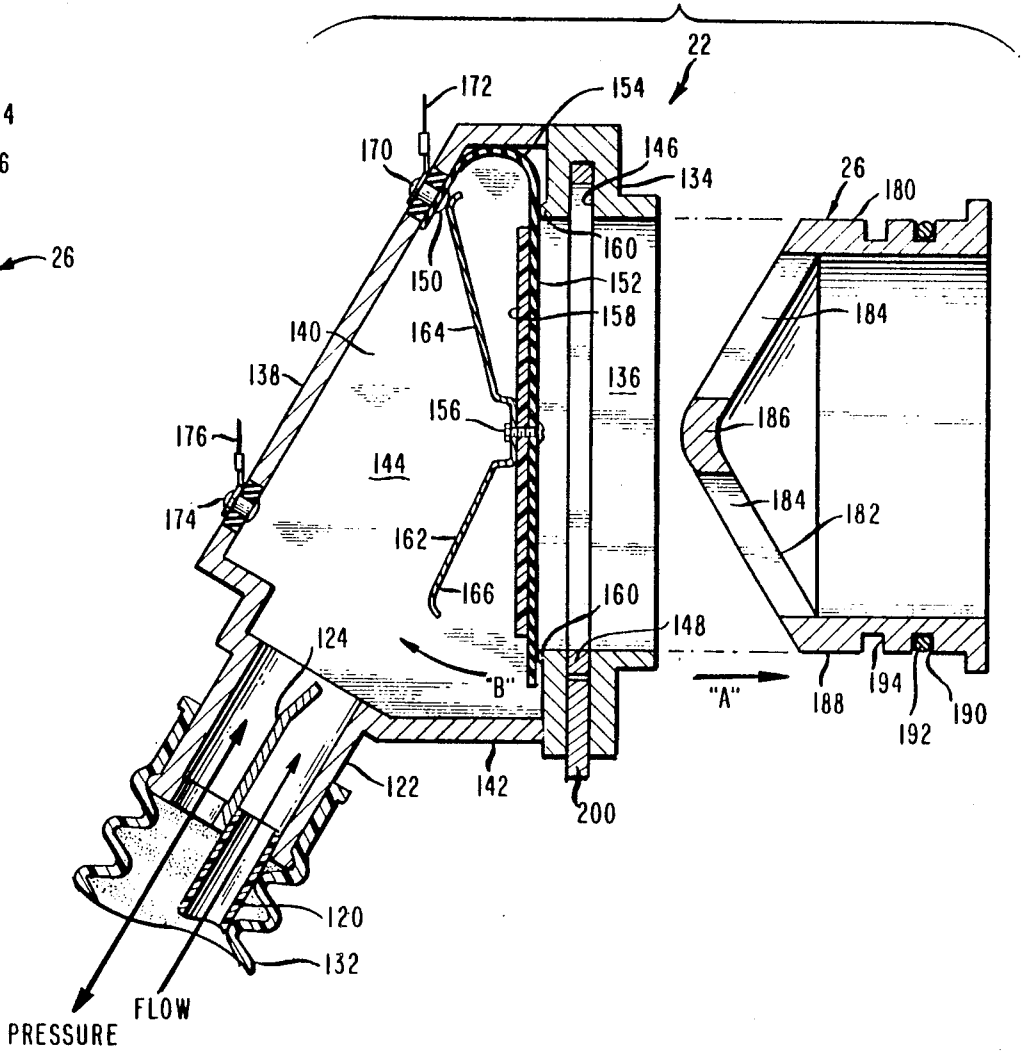
FIG. 4 is an enlarged cross-sectional view of the valve-face mask connecting assembly of FIG. 3 in detached mode.

The valve assembly 22, referring to FIGS. 3 and 4, and particularly FIG. 4, is comprised of a generally triangularly-shaped housing formed of front wall portion 134 including a cylindrically-shaped opening 136, an angularly-disposed rear wall member 138, sidewalls 140 (one shown) and a lower wall portion 142 defining a mixing chamber 144 in conjunction with the flow pattern created in conduit element 122. About the cylindrically-shaped opening 136 in the front wall portion 134, there is formed a cylindrically-shaped groove 146 in which is disposed a U-shaped spring member 148. To the rear wall member 138, there is mounted, such as by rivet 150, a resilient flap member 152 having an upper U-shaped area portion 154 providing a basis for attaching the flap member 152 to the rear wall member 138. Mounted to the resilient flap member 152, such as by pin member 156, there is provided a rigid circularly-shaped disc member 158 concentrically disposed with respect to the opening 136 to provide rigidity to the flap member 152 in a closed configuration. An interior portion of the front wall member 134 is provided with a circularly-shaped raised or beaded portion 160 providing a suitable seating surface for the flap member 152.

A spring member 162 having an upper arm portion 164 and a lower arm portion 166 is centrally mounted by the pin member 156 together with the rigid disc member 158 to the flap member 152. The upper arm portion 164 of the spring member 162 contacts an upper inner surface portion of the rear wall 138 and is free to slide on the wall when the valve is opened to bias the resilient flap member 152 in a closed position against the bead portion 160 of the front wall portion 134, referring particularly to FIG. 3. The rear wall 138 may be provided with an upper electrical contact member 170 including lead 172 connected through wall member 138 and in slidable contact with the upper arm portion 164 and with a lower electrical contact member 174 including lead 176. The spring member 162 provides a basis for closing an electrical circuit between the upper and lower contact members 170 and 174, referring to FIG. 3 upon connecting of the valve assembly 22 to the face mask gas connect member 26, as more fully hereinafter described.

The gas connect member 26 of the face mask 24 referring again to FIG. 4, is formed of a cylindrically-shaped housing member 180 having an outwardly extending conically-shaped inlet wall member 182 including orifices 184. The wall member 182 is formed with a terminal apex portion 186 providing a contact point for the pin 156 of the flap valve member 152, as more fully hereinafter described. An outer surface portion 188 of the housing member 180 is formed with a cylindrically-shaped groove 190 including a gasket member 192 and a cylindrically-shaped locking groove 194.

An electronic readout assembly 196, referring to FIG. 3, may be connected at one end to the lead 172 and connecting at another end via a battery 198 to the lead 176. The readout assembly is capable of displaying operative-inoperable mode or connection of the valve assembly 22 to the connecting assembly 26 as well as being connectable (not shown) to serve as a battery-conserving switch when used with other assemblies for displaying desired states of readiness, etc.

In operation, assuming positioning by the user of the supporting carrier assembly 12 upon the user's back and the proper positioning of the face mask 24 on the face of the user and the opening of the regulator valve 16 to permit availability of breathing gas from the container 14 to the pressure demand regulatory 18, the valve-face most connecting assembly 22 is caused to be positioned on the air connect member 26 of the face mask 24. In this condition, air is initially delivered to valve assembly 22 via conduits 116 and 122, and will immediately cease as pressure increases in mixing chamber 144, and is fed back through conduits 122 and 118, causing lever 98 to close valve assembly 56, as more fully described hereinafter. In positioning of the valve housing assembly 22, referring to FIG. 4, on the gas connect member 26 (as indicated by the arrow "A"), the pin member 156 of the flap valve member 152 contacts the apex portion 186 of the wall member 182 of the housing member 180 whereby the flap member 152 is caused to pivot counterclockwise (as indicated by the arrow "B") about the upper arm portion 154 of the flap member 152. Positioning of the valve housing assembly 22 over the connect member 26 is continued to the point where the U-shaped spring member 148 disposed in the groove 146 in the front wall portion 134, placed under compression during such positioning, is permitted to clamp into the groove 194 formed in the housing 180 of the gas connect member 26 thereby affixing the valve housing assembly 22 to the gas connect member 26 of the face mask 24. During such positioning, regulated access is permitted to the breathing gas from the cylinder 14 by the user through the pressure demand regulator, as described hereinafter.

Upon completion of positioning of the valve housing assembly 22 on the gas connecting member 26 of the face mask 24, as shown in FIG. 3 the arm member 166 of the spring member 162 is placed in contact with the contact 174 thereby closing the circuit between the battery 190 and related leads together with the readout assembly 196 to energize appropriate LED to visually provide to the user a positive connect mode between the valve housing assembly 22 and the gas connect member 26.

In an inhalation-exhalation condition of the user, referring more particularly to FIG. 2 and incidentally to FIG. 1, upon initiation and continuing to full inhalation, a reduction in pressure is caused to exist in the mixing chamber 144 of the valve housing assembly 22. Such reduction in pressure is pressure sensed in the chamber 46 of the demand regulator assembly 18 via the conduits 132 and 118 against the ambient pressure in chamber 44 thereof via the apertures 48 formed in the upper housing 32 of the demand regulator assembly 18. Such sensed pressure reduction results in a pressure differential with ambient pressure being greater to cause the lever 96 to pivot or rotate counterclockwise (as indicated by arrow "C") about the shaft 100 thereby permitting the piston 60 to slide from left to right as a result of the pressure of the gas in the channel 82 of the nozzle 62, i.e. the gas pressure in the chamber 82 is greater than the compressed force of the spring 88 thereby permitting gaseous flow of breathing air through the nozzle opening 84 into the surrounding chamber 92 and thence via the orifice 90 conduits 116 and 120 to the mixing chamber 144 of the gas connect member 26 to augment the inhalation medium. The piston 60 is spring-loaded to a force low enough to allow the gas pressure to open the nozzle 62-valve pad 80 assembly thereby providing a "fail-open" configuration.

Upon changing to an exhalation mode, there is a pressure increase in the mixing chamber 144 of the gas connect member 26 pressure-sensed in the chamber 46 of the demand regulator assembly 18 via the conduits 132 and 118 whereupon reaching a pressure greater than ambient pressure, the lever arm 98 of the lever assembly 96 is caused to rotate clockwise thereby causing the adjusting screw member 108 of the lever arm 104 to push against the rod 70 of the piston 60 and together with the available compression force of the spring 88 to overcome the pressure of the gas exiting the nozzle tip member 84 of the intermediate nozzle member 62 and eventually seat the seal member or valve pad 80 against the nozzle tip member 84 thereby arresting further gas flow therethrough. It will be understood by one skilled in the art that depending on the concomitant inhale/exhale cycle that gaseous flow is cyclic from 0 to 100 percent flow.

Generally, the lever arm assembly 96 provides about 75 percent of the force necessary to effect a seal between the seal member or valve pad 80 and the nozzle tip member 84—the remaining force provided by compression forces of the spring 88 as against the available pressure level of breathing gas available to the gas inlet from the gaseous cylinder 14 via the pressure reduction valve 16.

Upon completion of a use period, the user depresses a button member 200 FIG. 3 on the valve housing assembly 22 to effect expansion of the U-shaped spring member 148 to permit the spring member to retract from the groove 194 of the housing member 180 of the gas connect member 26 permitting withdrawal of the valve housing assembly 22 from the gas connect member 26 (a direction opposite to the direction of arrow "A") During withdrawal of valve housing assembly 22, the compression forces on the flap member 152 generated through the arm portion 164 of the spring member 162 causes the flap member 152 to rotate or pivot counterclockwise to effect sealing of the resilient flap member 152 against the bead 160 formed on the front wall member 134 of the valve housing assembly 22. The sealing of the flap member 152 against the bead 160 effectively discontinues further gaseous flow out of the valve housing assembly 22 from the air or gas cylinder 14 via the pressure regulator 16, demand regulator assembly 18, conduit assembly 20 and associated conduits, etc.

While the invention has been described in connection with an exemplary embodiment thereof, it will be understood that many modifications will be apparent to those of ordinary skill in the art; and that this application is intended to cover any adaptations of variations thereof. Therefore, it is manifestly intended that this invention be only limited by the claims and the equivalents thereof.

What is claimed:

1. A breathing assembly for use by a wearer and including a respiratory face mask for supplying breathing gas to said wearer, which assembly comprises:

a compressed breathing gas supply tank;

a pressure reducer valve having an inlet and an outlet;

a pressure demand regulator valve assembly, located remotely from said respiratory face mask;

a first line for providing fluid flow between said breathing gas supply tank and said pressure reducer valve and a second line for providing fluid flow between said pressure reducer valve and said pressure demand regulator valve assembly;

first and second conduit means connectable between said respiratory face mask and said pressure demand regulator valve assembly;

said pressure demand regulator valve assembly comprised of:

a valve housing defining a chamber and including a gas inlet housing;

a resilient member dividing said chamber into an ambient chamber in fluid flow communication with ambient pressure and a pressure chamber in fluid flow communication with a breathing apparatus through said first conduit means;

a valve assembly disposed in said inlet housing for fluid flow communication with a source of compressed gas and defining a feed gas chamber with said gas inlet housing, said feed gas chamber in fluid flow communication with said breathing apparatus through said second conduit means, and said valve assembly including a nozzle member and a piston member extending into said feed gas chamber and disposed in an end to end relationship;

said nozzle member including a nozzle tip portion, said piston member cooperating with said nozzle tip portion to provide a closed valve position and an opened valve position wherein upon said valve assembly being in said open position fluid flow communication is provided between said source of compressed gas and said breathing apparatus through said feed gas chamber and said second conduit means; and an arm member mounted pivotably about a pivot in said pressure chamber of said valve housing and connected to said resilient member for pivoting between first and second positions, said arm member engageable with said piston member of said valve assembly to cause said piston member to move into and out of engagement with said nozzle tip to provide said closed and opened valve positions in response to movement of said arm member between said first and second positions caused by changes in pressure in said pressure chamber of said valve housing which changes are caused by changes in pressure in said breathing apparatus sensed by said pressure chamber through said first conduit means.

2. The breathing assembly as defined in claim 1 wherein said piston member of said valve assembly is spring loaded into said closed position.

3. The breathing assembly as defined in claim 1 or 2 wherein said piston member includes forward and rearward ends and wherein a resilient valve pad is provided at said forward end for being moved into and out of said engagement with said nozzle tip portion of said nozzle member.

4. The breathing assembly as defined in claim 3 wherein said arm member is pivotally mounted adjacent said rearward end of said piston member for engagement therewith.

5. The breathing assembly as defined in claim 4 wherein said arm member includes a long arm portion and a short arm portion formed about said pivot, said long arm portion connected to said resilient member to provide leverage to facilitate movement of said arm into said first and second positions.

6. The pressure demand regulator valve assembly as defined in claim 5 wherein said short arm portion of said arm member includes an adjusting member for connecting said rearward end of said piston member.

7. In a breathing assembly including a face mask and a pressure demand regulator for providing pressurized breathing gas to said face mask when worn by a user of said breathing gas, said regulator including conduit means for communicating said pressurized breathing gas to said face mask and for communicating the pressure in said face mask to diaphragm means, valve means for being opened to supply said pressurized breathing gas to said face mask through said conduit means, said diaphragm means for sensing said pressure in said face mask through said conduit means, and lever means operably interconnecting said diaphragm with said valve means to operate said valve means in response to pressure sensed by said diaphragm means. WHEREIN THE IMPROVEMENT COMPRISES;

said conduit means comprising first and second conduit means, said first conduit means for communicating said pressure in said face mask to said diaphragm means and said second conduit means for communicating said pressurized breathing gas to said face mask upon said valve means being opened; and said pressure demand regulator comprising fluid flow communication means for placing said diaphragm means in fluid flow communication with the ambient open.

8. In a assembly including a pressure demand regulator for communicating pressurized breathing gas to breathing apparatus worn by a user of said breathing gas, said pressure demand regulator including an inlet for the admission of said pressurized breathing gas into said regulator and valve means for communicating said pressurized breathing gas to said breathing apparatus upon being opened, and diaphragm means and arm means for closing said valve means WHEREIN THE IMPROVEMENT COMPRISES:

said valve means including a nozzle and a reciprocably mounted piston for engaging said nozzle to close said valve means and for being moved out of engagement with said nozzle to open said valve means, said nozzle in direct fluid flow communication with said inlet, and upon said pressurized breathing gas being admitted into said inlet and through said nozzle said piston responsive solely to said pressurized breathing gas to move out of engagement with said nozzle to open said valve means to communicate said pressurized breathing gas to said breathing apparatus.

9. In a breathing assembly including a face mask and a pressure demand regulator for providing pressurized breathing gas to said face mask when worn by a user of said, said regulator including conduit means for communicating said pressurized breathing gas to said face mask and for communicating the pressure in said face mask to diaphragm means, valve means for being opened to supply said pressurized breathing gas to said face mask through said conduit means, said diaphragm means for sensing said pressure in said face mask through said conduit means, and lever means operably interconnecting said diaphragm with said valve means to operate said valve means in response to pressure sensed by said diaphragm means WHEREIN THE IMPROVEMENT COMPRISES:

said conduit means comprising first and second conduit means, said first conduit means for communicating said pressure in said face mask to said diaphragm means and said second conduit means for communicating said pressurized breathing gas to said face mask upon said valve means being opened; and said valve means responsive solely to said pressurized breathing gas operating thereagainst to be opened thereby to communicate said pressurized breathing gas to said face mask through said second conduit means, and said diaphragm means upon sensing a predetermined pressure in said face mask through said first conduit means being moved by said sensed predetermined pressure to close said valve means through said lever means; and said pressure demand regulator comprising fluid flow communication means for placing said diaphragm means in fluid flow communication with the ambient.

10. In a breathing assembly including a face mask and a pressure demand regulator for communicating pressurized breathing gas to said face mask when worn by a user of said breathing gas, said pressure demand regulator including an inlet for the admission of said pressurized breathing gas into said regulator, valve means for communicating said pressurized breathing gas to said breathing apparatus upon being opened, diaphragm means sensitive to the pressure in said breathing apparatus and operable in response thereto to open and close said valve means, and fluid flow communication means for communicating said pressure in said breathing apparatus to said diaphragm means and for communicating said breathing gas to said breathing apparatus, WHEREIN THE IMPROVEMENT COMPRISES:

said fluid flow communication means including first and second conduit means, said first conduit means for communicating said pressure in said breathing apparatus to said diaphragm means to cause said diaphragm means to close said valve means and to allow said valve means to open in response solely to said pressurized breathing gas and said second conduit means connecting said pressurized breathing gas to said breathing apparatus upon said valve means being opened; and said valve means having first and second sides, said first side connected directly to said inlet and said second side for being connected directly to said breathing apparatus by said second conduit means, and upon said pressurized breathing gas being communicated to said first side of said valve means said valve means responsive solely to said pressurized breathing gas to be opened by said pressurized breathing gas to communicate said pressurized breathing gas to said breathing apparatus through said second conduit means and to continue communicate said pressurized breathing gas to said breathing apparatus through said second conduit means until said diaphragm means closes said valve means upon sensing a first pressure in said breathing apparatus through said first conduit means, and upon said diaphragm means sensing a second pressure in said breathing apparatus through said first conduit means said diaphragm means allowing said valve means again to be responsive solely to said pressurized breathing gas to be opened thereby to again communicate said pressurized breathing gas to said breathing apparatus through said second conduit means; and said pressure demand regulator comprising fluid flow communication means for placing said diaphragm means in fluid flow communication with the ambient.

11. In a breathing assembly including a face mask and a pressure demand regulator for communicating pressurized breathing gas to said face mask when worn by a user of said breathing gas, said pressure demand regulator including an inlet for the admission of said pressurized breathing gas into said regulator, valve means for communicating said pressurized breathing gas to said breathing apparatus upon being opened, diaphragm means sensitive to the pressure in said breathing apparatus and operable in response thereto to close and open said valve means, and fluid flow communication means for communicating said breathing gas to said breathing apparatus and for communicating pressure in said breathing apparatus to said diaphragm means, WHEREIN THE IMPROVEMENT COMPRISES:

said fluid flow communication means including first and second conduit means, said first conduit means communicating the pressure in said breathing apparatus to said diaphragm means to cause said diaphragm means to close valve means and to allow said valve means to open in response solely to said pressurized breathing gas, and said second conduit means communicating said pressurized breathing gas to said breathing apparatus upon said valve means being opened; and said valve means including a nozzle and a reciprocably mounted piston for engaging said nozzle to close said valve means and for being moved out of engagement with said nozzle to open said valve means, said nozzle in direct fluid flow communication with said inlet, and upon said pressurized breathing gas being admitted into said inlet and through said nozzle said pressurized breathing gas solely moving said piston out of engagement with said nozzle to open said valve means to communicate said pressurized breathing gas to said breathing apparatus through said second conduit means; and said pressure demand regulator comprising fluid flow communication means for placing said diaphragm means in fluid flow communication with the ambient.

12. Breathing assembly for communicating pressurized breathing gas from a source thereof to the face mask of a user of said breathing gas, comprising:

housing means providing a housing chamber and a pressurized breathing gas chamber and including a pressurized breathing gas inlet in fluid flow communication with said pressurized breathing gas chamber, said housing means provided with first and second openings and with at least one third opening;

a diaphragm mounted in said housing means and dividing said housing chamber into an ambient chamber in fluid flow communication with ambient pressure through said third opening and a pressure chamber, said housing means further provided with a fluid passageway placing said pressure chamber in fluid flow communication with said said first opening, said second opening extending into said pressurized breathing gas chamber and said third opening placing said ambient chamber in fluid flow communication with the ambient;

first and second conduit means, said first conduit means placing said first opening in fluid flow communication with said face mask and said second conduit means placing said second opening in fluid flow communication with said face mask;

a valve assembly mounted in said pressurized breathing gas chamber and including a nozzle member and a reciprocably mounted piston member disposed in an end to end relationship, said nozzle member and said piston member each having forward and rearward ends, said nozzle member provided with a nozzle tip portion at its forward end and provided with an internal channel extending longitudinally therethrough and said internal channel placing said nozzle tip portion in fluid flow communication with said pressurized breathing gas inlet at said rearward end of said nozzle, and said nozzle tip portion for being engaged by said forward end of said piston member to close said valve assembly and upon said piston member being moved out of engagement with said nozzle tip portion said valve assembly being opened;

an arm member mounted pivotally adjacent said rearward end of said piston member in said pressure chamber and said arm member connected to said diaphragm to be pivoted thereby;

upon said pressurized breathing gas being admitted into said gas inlet, said pressurized breathing gas flowing thought said internal channel of said nozzle and into engagement with said forward end of said valve member to solely move said valve member out of engagement with said nozzle tip portion to open said valve assembly and communicate said pressurized breathing gas from said source thereof said internal chamber, said pressurized breathing gas chamber, said second opening and said second conduit means to said face mask;

upon a first pressure being established in aid face mask, said first pressure being sensed by said diaphragm through said first conduit means, said first opening and said fluid passageway whereby said diaphragm pivots said arm member into engagement with said rearward end of said piston member to move said forward end of said piston member into engagement with the nozzle tip portion to close said valve assembly and cease communication of said pressurized breathing gas to said face mask; and upon a second pressure being established in said face mask, said second pressure being sensed by said diaphragm through said first conduit means, said first opening and said fluid passageway whereby said diaphragm pivots said arm member away from said rearward end of said valve member whereby said pressurized breathing gas again solely moves said forward end of said valve member out of engagement with said nozzle tip portion to again communicate said pressurized breathing gas from said source thereof through said internal chamber, said pressurized breathing gas chamber, said second opening sand said second conduit means to said face mask.

* * * * *